US005622318A

United States Patent [19]

Bougamont et al.

[11] Patent Number: 5,622,318

[45] Date of Patent: Apr. 22, 1997

[54] SPRAY NOZZLE FOR AN AEROSOL DISPENSER

[75] Inventors: Jean-Louis Bougamont, Eu; Pierre DuMont, Houdain; Hervé Lompech, Criel sur Mer, all of France

[73] Assignee: Sofab, Le Treport, France

[21] Appl. No.: 332,948

[22] Filed: Nov. 1, 1994

[30] Foreign Application Priority Data

Nov. 3, 1993 [FR] France ..... 93 13055

[51] Int. Cl.[6] ..... B05B 1/34

[52] U.S. Cl. ..... 239/490; 239/333

[58] Field of Search ..... 239/333, 463, 239/490–493; 222/383.1

[56] References Cited

U.S. PATENT DOCUMENTS

| | | | |
|---|---|---|---|
| 3,112,074 | 11/1963 | Green | 239/493 |
| 4,109,869 | 8/1978 | Brockelsby et al. | 239/491 |
| 4,227,650 | 10/1980 | McKinney | 239/492 X |
| 4,358,057 | 11/1982 | Burke | 239/492 X |
| 4,365,751 | 12/1982 | Saito et al. | 239/333 |
| 4,673,110 | 6/1987 | Workum | 239/493 X |
| 4,819,835 | 4/1989 | Tasaki | 239/333 X |

FOREIGN PATENT DOCUMENTS

| | | | |
|---|---|---|---|
| 322488 | 7/1989 | European Pat. Off. | 239/333 |
| 1226549 | 2/1960 | France . | |
| 166432 | 1/1934 | Switzerland . | |

*Primary Examiner*—Andres Kashnikow
*Assistant Examiner*—Lesley D. Morris
*Attorney, Agent, or Firm*—Rosen, Dainow & Jacobs, L.L.P.

[57] ABSTRACT

A spray device for mounting on a fluid dispenser connected to a tank; the device being of the type comprising a head provided with an expansion chamber into which the outlet orifice of said dispenser opens out; the expansion chamber communicating with a nozzle via at least one outlet duct. The nozzle is constituted by a hinged inner element which is at least partially received in the outlet duct, and by an outer element fixed to bear in sealed manner against the inner element so as to define between their respective contacting surfaces a network of swirl-inducing channels communicating with the outlet duct and opening to the outside via a spray orifice formed through the outer element.

7 Claims, 3 Drawing Sheets

SPRAY NOZZLE FOR AN AEROSOL DISPENSER

FIELD OF THE INVENTION

The present invention relates to a spray device.

BACKGROUND OF THE INVENTION

Traditional spray devices already exist in the form of a pushbutton for mounting on a fluid dispenser (a pump, a valve, . . .) connected to a tank.

Fluid, and in particular liquid, is taken from the tank and then sprayed in the form of a spray of microdroplets after being dispersed in a head that includes an expansion chamber into which the ejection orifice of the dispenser opens out and which communicates with a nozzle via at least one outlet duct.

The nozzle is constituted by an add-on part which is generally in the form of a cup having a central orifice and which is mounted on the head.

The nozzle co-operates with elements of the head against which it bears to define a network of swirl-inducing channels.

Unfortunately, it often happens that the nozzle is not properly assembled to the head, and consequently that the network of channels includes leaks giving rise to losses of head or to reductions in the characteristics of the spray (asymmetrical spray, direct jets, increase in the size of the micro-droplets, increase in size dispersion).

Assembly faults are mainly due to poor positioning of the nozzle, which poor positioning is not accommodated or compensated by the corresponding elements of the head because of their rigidity and because they are not removable.

OBJECT AND BRIEF SUMMARY OF THE INVENTION

An object of the present invention is to solve the above technical problem in a satisfactory manner.

According to the invention, this object is achieved by a spray device for mounting on a fluid dispenser connected to a tank; the device being of the type comprising a head provided with an expansion chamber into which the outlet orifice of said dispenser opens out; the expansion chamber communicating with a nozzle via at least one outlet duct; wherein said nozzle is constituted by a hinged inner element which is at least partially received in the outlet duct, and by an outer element fixed to bear in sealed manner against said inner element so as to define between their respective contacting surfaces a network of swirl-inducing channels communicating with the outlet duct and opening to the outside via a spray orifice formed through the outer element.

According to an advantageous feature, said hinged inner element comprises a central core and a peripheral sleeve disposed coaxially and defining between them a dispensing enclosure inside the outlet duct, said core and sleeve being interconnected by at least one transverse fin that is elastically deformable to enable said core to move relative to said sleeve by bearing contact from said outer element.

In a first embodiment, said peripheral sleeve is constituted by a cylindrical front portion extended towards its back by a radial annular shoulder that bears against the inside of a corresponding recess formed in the inner wall of the outlet duct, while said central core includes a front end provided with a contact face for contacting the outer element which extends in a plane that is substantially perpendicular to the longitudinal axis of the inner element, and a back end having a profile that is tapering and/or rounded.

Under such conditions, said outer element includes a cylindrical inner housing adapted to receive the front portion of said sleeve; the side wall of said housing terminating towards its back end in a collar which is for fixing against the inside wall of the outlet duct and which comes into abutment against the radial shoulder of said sleeve of the inner element.

In a second embodiment of the invention, said outer element is in the form of a cup whose plane back face comes into bearing contact against the respective front faces of the core and of the sleeve.

In a third embodiment, the sleeve of the inner element is integrally formed with the head, and under such circumstances, the fins are provided behind the core and are integral with the wall of the expansion chamber.

Said network of swirl-inducing channels may be defined firstly by the front and back faces respectively of the inner element and of the outer element, and secondly by an axial ring split up by grooves formed on the front face of the core of the inner element or on the back face of the outer element. Said ring forms a spacer or a contact abutment between the inner element and the outer element and surrounds a central cavity which is fed from the outlet duct via said grooves, and which opens directly to the outside via the spray orifice.

In addition, said grooves pass tangentially through said ring in such a manner as to produce turbulence inside said central cavity.

In a first variant, said axial ring is made on the front face of said core of the inner element and the end wall of the central cavity is situated in the plane containing the front edge of said sleeve.

In another variant, said axial ring is made on the back face of said outer element.

Preferably, the length of the core is greater than the length of the sleeve in such a manner that the back end of the core projects into the outlet duct towards the expansion chamber.

Because of the invention, spray quality (direction, uniformity, . . .) is considerably improved since the swirling and turbulent movements of the fluids are no longer disturbed.

The path followed by the fluids between the ejection orifice of the dispenser and the spray orifice is thus more confined, thereby making it possible to feed the grooves and the central cavity in a manner that is homogeneous and better balanced, but without giving rise to loss of head.

The inner and outer elements constituting the device of the invention are very easy to make using traditional methods. They are very simple to assemble in the head without risk of error or of defects.

BRIEF DESCRIPTION OF THE DRAWINGS

The invention will be better understood on reading the following description accompanied by the drawings, in which.

MORE DETAILED DESCRIPTION

The spray device of the invention as shown in the figures is designed to be mounted on a pump connected to a tank of liquid (not shown).

Figure 1:
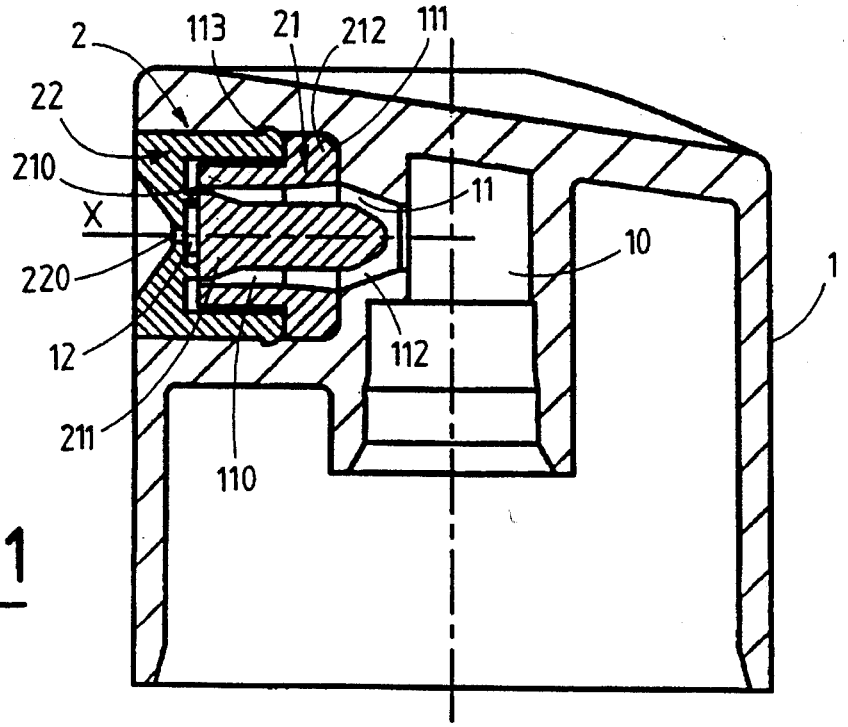
FIG. 1 is a section view through a first embodiment of a spray device of the invention.

The embodiment shown in FIG. 1 comprises a head 1 adapted to be placed on top of the tank and provided with an expansion chamber 10 into which the outlet orifice of the pump opens out. The expansion chamber 10 communicates via at least one outlet duct 11 with a spray nozzle 2.

Applying manual pressure to the top face of the head 1 causes a spray in the form of a jet of pulverized micro-droplets to be emitted from the nozzle.

The nozzle 2 is constituted by an inner element 21 and by an outer element 22.

The inner element 21 is received, at least in part, in the duct 11.

The outer element 22 is fixed in leakproof manner against the inner element 21 at the outlet from the duct 11 in such a manner as to define between their respective compacting surfaces a network of swirl-inducing channels which communicate with the duct 11 and which open to the outside via a spray orifice 220 formed through the outer element 22.

The outer element 22 is provided with a front face 22*a* constituting a deflector of predetermined aperture angle depending on the kind of jet required.

The kind of jet also depends on the shape of the channels and on the shape of the spray orifice 220.

The inner element 21 is hinged so as to ensure that the outer element 22 is properly pressed thereagainst, thereby guaranteeing an assembly in which there are no leaks around the swirl-inducing channels.

To this end, the inner element 21 comprises a central core 211 and a peripheral sleeve 212 disposed coaxially around the core 211.

The sleeve 212 is cylindrical, at least in part, and it surrounds the core 211 at a distance suitable for defining a dispensing enclosure 110 between them that is of annular section and that lies within the outlet duct 11.

Figure 2B:
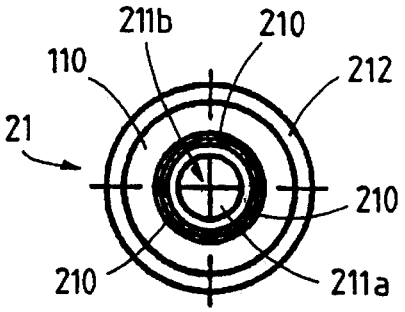
FIGS. 2*a* and 2*b* are respectively a section view and a face view of the first embodiment of the inner element of the nozzle of the invention.
Figure 2A:
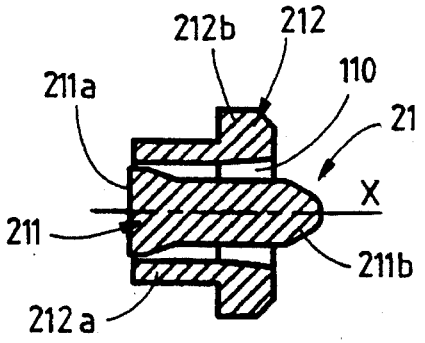

The core 211 and the sleeve 212 are interconnected by at least one, and preferably by three, transverse fins 210 (see also FIGS. 2*a* and 2*b*). The fins 210 are elastically deformable so as to constitute a hinge enabling the core 211 to move relative to the sleeve 212.

Since the sleeve 212 is secured to the inside wall of the duct 11, it remains motionless.

The displacement available to the core 211 is of small amplitude, but when pressed against the outer element 22, it serves to compensate for possible misalignment or to accommodate a manufacturing defect.

The three fins are symmetrically disposed (at angular intervals of 120°) and interconnect the respective front portions of the core 211 and of the sleeve 212.

The core 211 thus co-operates with the fins 210 to produce a spring effect which imparts flexibility to the assembly and avoids headloss in the channels.

As shown in FIGS. 2*a* and 2*b*, the peripheral sleeve 212 is constituted by a cylindrical front portion 212*a* that is extended at its back end by an annular radial shoulder 212*b*.

The radial shoulder 212*b* bears against a corresponding recess 111 that constitutes an abutment and that is formed in the inside wall of the duct 11.

The inside face of the shoulder 212*b* is chamfered, thereby causing the flow of liquid from the expansion chamber 10 to converge in the duct 11 on its way to the dispensing enclosure 110.

To enhance this phenomenon, the passage 112 providing communication between the duct 11 and the chamber 10 is a diverging passage.

In addition, the central core 212 has a cylindroconical profile and its back end 211*b* tapers and/or is convex.

The length of the core is greater than the length of the sleeve 212 such that its back end 211*b* projects into the passage 112 towards the chamber 10 so as to split up the flow coming from the dispenser. The front end 211*a* of the core 211 is provided with a contact face for engaging the outer element 22. The contact face extends in a plane that is substantially perpendicular to the common longitudinal axis X of the inner element 21, of the outer element 22, and of the duct 11.

Figure 3B:
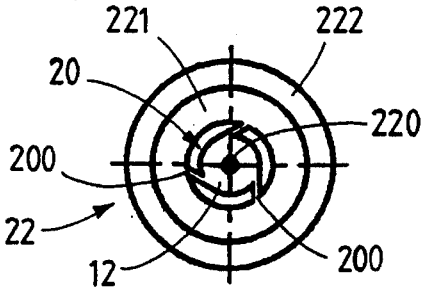
FIGS. 3*a* and 3*b* are respectively a section view and a face view of the first embodiment of the outer element of the nozzle of the invention.
Figure 3A:
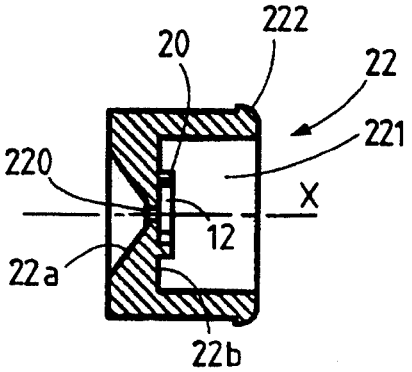

The outer element as shown in FIGS. 3*a* and 3*b* includes a cylindrical internal housing 221 adapted to receive the front portion 212*a* of the sleeve 212. The outside face of the front portion 212*a* of the sleeve 212 fits closely in sealed manner against the inside face of the housing 221 in the outer element 21.

The side wall of the housing 221 terminates towards the back in a fixing collar 222 that enables it to be snap-fastened behind a retaining ring 113 formed in the inside wall of the duct 11, or if there is no such retaining ring to dig directly into the inside wall of said duct 11. The collar 222 comes into abutment at its back end against the shoulder 212*b* of the sleeve 212.

As shown in FIGS. 3*a*, 3*b*, and 5*a*, 5*b*, the network of swirl-inducing channels is defined firstly by the front face 211*a* of the inner element 21 and the back face 22*b* of the outer element 22, and secondly by a ring 20 about the axis X, which ring is split up by grooves 200. The ring 20 is made on the front face 211*a* of the core 211 (FIG. 5*b*) or else on the back face 22*b* of the outer element 22 (FIG. 3*a*). The ring thus forms a spacer or contact abutment between the inner element 21 and the outer element 22 and it surrounds a central cavity 12 which is fed from the duct 11, and more precisely from the dispenser enclosure 110, via the grooves 200. The central cavity 12 opens out directly to the outside via the spray orifice 220.

The duct 11 and the enclosure 110 communicate with the central cavity 12 via peripheral passages situated between the fins 210, thereby increasing the turbulence of the flow.

The grooves 200 pass through the flank of the ring 20 along directions that are predetermined so as to establish conditions inside the cavity 12 that are both turbulent and swirling.

The slope of the grooves is preferably such that they are tangential to the inside periphery of the ring 20.

Figure 4:
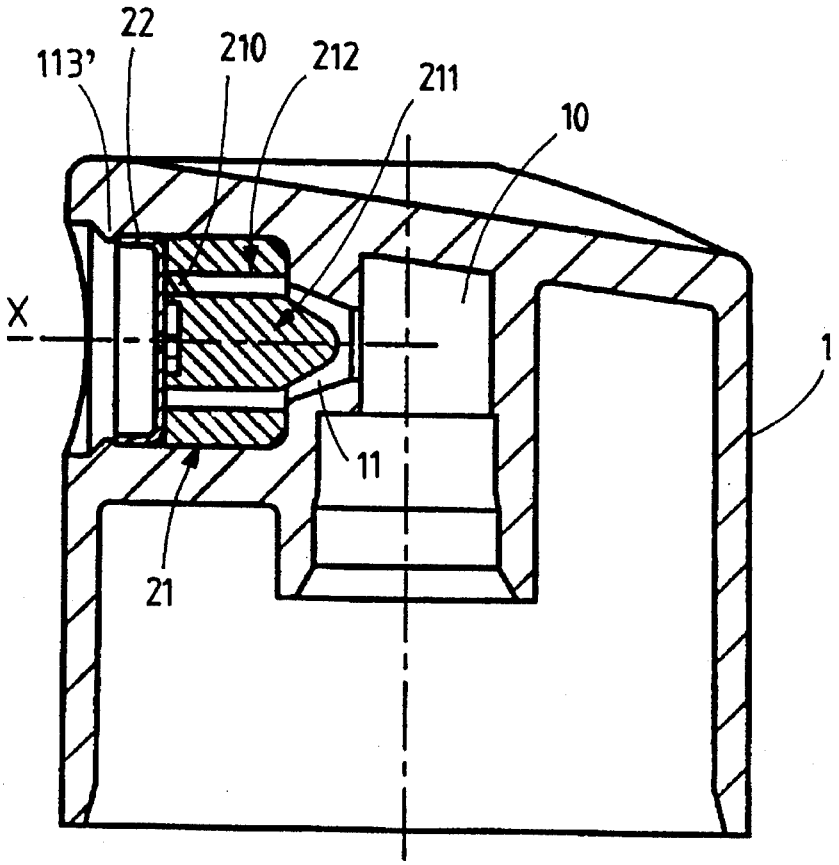
FIG. 4 is a section view of a second embodiment of the device of the invention.
Figure 5A:
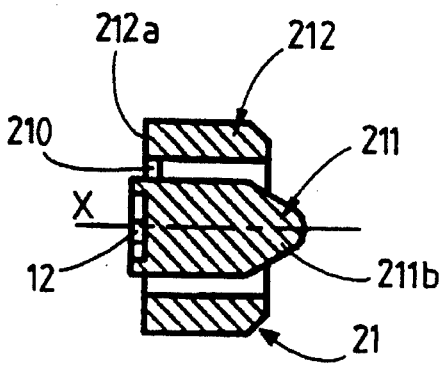
FIGS. 5*a* and 5*b* are respectively a section view and a face view of the inner element of the nozzle of the invention.
Figure 5B:
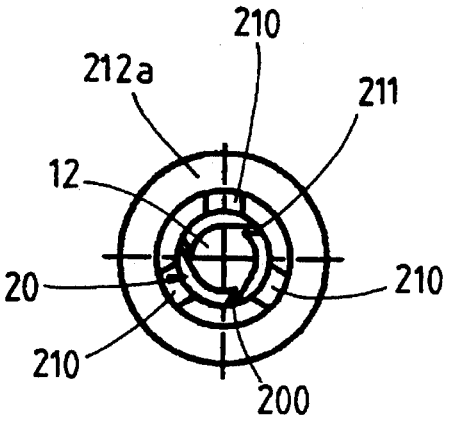

In FIGS. 4, 5*a*, and 5*b*, the ring 20 is made on the front face 211*a* of the core 211 and the end wall of the central cavity 12 is situated in the plane that contains the front edge 212*a* of the sleeve 212.

In this way, the front face 211*a* of the core projects at rest relative to the front edge 212*a*, but it is pushed in by elastic deformation of the fins 210 when pressed against the outer element 22.

In FIG. 4, the outer element 22 is in the form of a cup whose front face is concave and whose plane back face comes into bearing contact both against the front face of the core 211 and against the front face of the sleeve 212.

The cup is held in place by its free edge snap-fastening behind a retaining ring 113' formed in the inside wall of the duct 11.

Figure 6A:
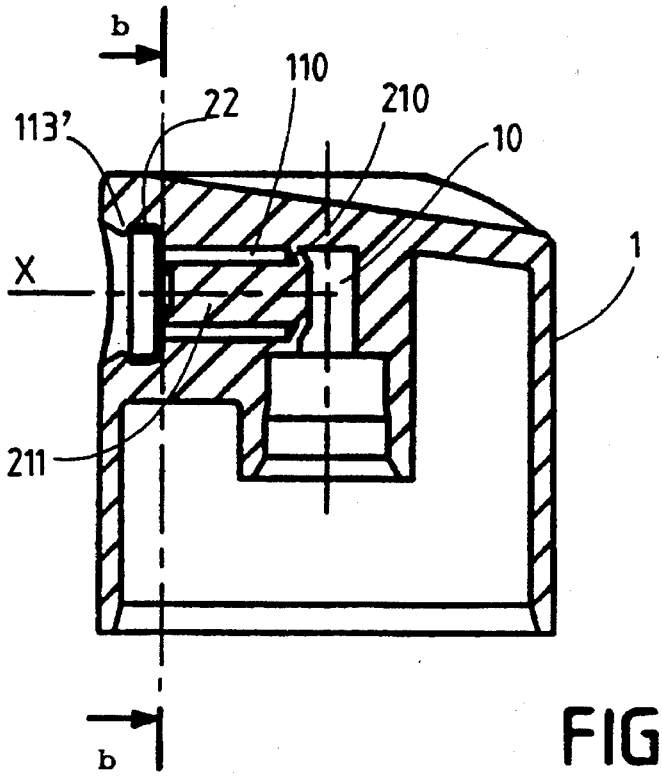
FIGS. 6*a* and 6*b* are respectively a cross-section view and a view on bb of a third embodiment of the invention.
Figure 6B:
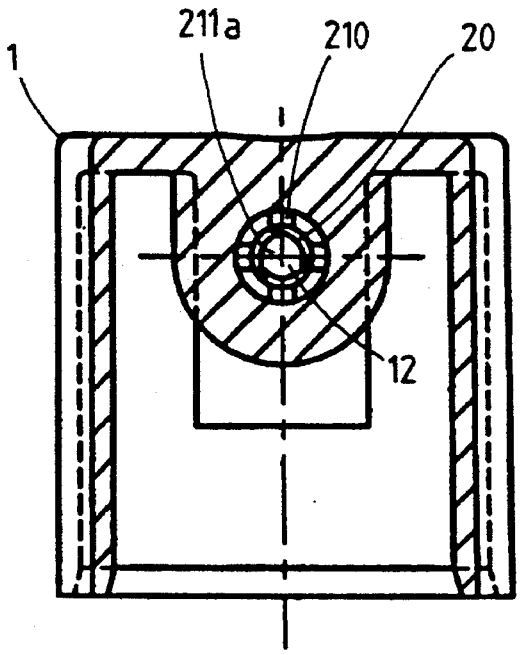

In the embodiment of FIGS. 6*a* and 6*b*, the outer element 22 is in the form of a cup as in FIG. 4, and the sleeve of the inner element 21 is integrally formed with the head 1.

The fins 210 are then provided at the back of the core 211 and they coincide with the wall of the expansion chamber 10, while the ring 20 is formed on the front face 211*a* of the core 211.

By way of example, the wall separating the chamber 10 from the duct 11 is perforated so as to define the fins 210, and the wall deforms elastically when the core 211 is pushed in.

We claim:

1. A spray device for mounting on a fluid dispenser connected to a tank; the spray device comprising a head having an expansion chamber into which an outlet orifice of said fluid dispenser opens into, said expansion chamber communicating with a nozzle via at least one outlet duct having an inner wall; wherein said nozzle includes an inner element which is at least partially received in the at least one outlet duct and which comprises a core having a front face and a back end, and a peripheral sleeve having a front portion disposed coaxially therewith and defining between them a dispensing enclosure inside the at least one outlet duct, said core and peripheral sleeve being interconnected by at least one transverse fin which is elastically deformable to enable said core to move relative to said peripheral sleeve, and which nozzle further includes an outer element having a back face in contact with said inner element so as to define between their respective contacting surfaces a network of swirl-inducing channels communicating the at least one outlet duct and a spray orifice formed as part of the outer element;

wherein the inner wall of the at least one outlet duct further includes a corresponding recess formed therein: said corresponding recess includes an inside surface; and wherein said peripheral sleeve further includes a cylindrical front portion, which extends to a radial annular shoulder bearing against the inside surface of said corresponding recess.

2. A device according to claim 1, wherein the peripheral sleeve has an inside face which is chamfered in the proximity of the radial shoulder of the peripheral sleeve.

3. A spray device for mounting on a fluid dispenser connected to a tank; the spray device comprising a head having an expansion chamber into which an outlet orifice of said fluid dispenser opens into, said expansion chamber communicating with a nozzle via at least one outlet duct having an inner wall; wherein said nozzle includes an inner element which is at least partially received in the at least one outlet duct and which comprises a core having a front face and a back end, and a peripheral sleeve having a front portion disposed coaxially therewith and defining between them a dispensing enclosure inside the at least one outlet duct, said core and peripheral sleeve being interconnected by at least one transverse fin which is elastically deformable to enable said core to move relative to said peripheral sleeve, and which nozzle further includes an outer element having a back face in contact with said inner element so as to define between their respective contacting surfaces a network of swirl-inducing channels communicating the at least one outlet duct and a spray orifice formed as part of the outer element;

wherein the at least one transverse fin extends between and interconnects the front face of the core and the front portion of the peripheral sleeve; and wherein said outer element includes a cylindrical inner housing having a side wall adapted to receive the front portion of said peripheral sleeve; the side wall of said cylindrical inner housing terminating towards a back end in a fixing collar fixed against the inner wall of the at least one outlet duct and which abuts a radial shoulder of the peripheral sleeve of the inner element.

4. A device according to claim 3, wherein an outside face of the front portion of the peripheral sleeve is fitted in a leakproof manner with the cylindrical inner housing of the outer element.

5. A spray device for mounting on a fluid dispenser connected to a tank; the spray device comprising a head having an expansion chamber into which an outlet orifice of said fluid dispenser opens into, said expansion chamber communicating with a nozzle via at least one outlet duct; wherein said nozzle includes an inner element which is at least partially received in the at least one outlet duct and which comprises a core having a front face and a back end, and a peripheral sleeve having a front portion disposed coaxially therewith and defining between them a dispensing enclosure inside the at least one outlet duct, said core and peripheral sleeve being interconnected by at least one transverse fin which is elastically deformable to enable said core to move relative to said peripheral sleeve, and which nozzle further includes an outer element having a back face in contact with said inner element so as to define between their respective contacting surfaces a network of swirl-inducing channels communicating the at least one outlet duct and a spray orifice formed as part of the outer element;

wherein said network of swirl-inducing channels is further defined by the front face of the core, the back face of the outer element, and by an axial ring split by grooves;

wherein said axial ring forms a contact abutment between the inner element and the outer element and surrounds a central cavity which is fed from the at least one outlet duct via said grooves, and which opens to the spray orifice; and wherein said axial ring is present on the front face of said core and which axial ring has an end and further where the end of the axial ring is coplanar with the front portion of said peripheral sleeve.

6. A spray device for mounting on a fluid dispenser connected to a tank; the spray device comprising a head having an expansion chamber into which an outlet orifice of said fluid dispenser opens into, said expansion chamber communicating with a nozzle via at least one outlet duct; wherein said nozzle includes an inner element which is at least partially received in the at least one outlet duct and which comprises a core having a front face and a back end, and a peripheral sleeve having a front portion disposed coaxially therewith and defining between them a dispensing enclosure inside the at least one outlet duct, said core and peripheral sleeve being interconnected by at least one transverse fin which is elastically deformable to enable said core to move relative to said peripheral sleeve, and which nozzle further includes an outer element having a back face in contact with said inner element so as to define between their respective contacting surfaces a network of swirl-inducing channels communicating the at least one outlet duct and a spray orifice formed as part of the outer element;

wherein the length of the core is greater than the length of the peripheral sleeve such that the back end of the core projects into the at least one outlet duct towards the expansion chamber.

7. A spray device for mounting on a fluid dispenser connected to a tank; the spray device comprising a head having an expansion chamber into which an outlet orifice of said fluid dispenser opens into, said expansion chamber communicating with a nozzle via at least one outlet duct; wherein said nozzle includes an inner element which is at least partially received in the at least one outlet duct and which comprises a core having a front face and a back end, and a peripheral sleeve having a front portion disposed coaxially therewith and defining between them a dispensing enclosure inside the at least one outlet duct, said core and peripheral sleeve being interconnected by at least one transverse fin which is elastically deformable to enable said core to move relative to said peripheral sleeve, and which nozzle further includes an outer element having a back face in contact with said inner element so as to define between their respective contacting surfaces a network of swirl-inducing channels communicating the at least one outlet duct and a spray orifice formed as part of the outer element;

wherein the front face of said core projects, at rest, from the plane containing the front portion of said peripheral sleeve, and is pushed in elastically when pressed against the outer element.

* * * * *